US010196823B2

(12) United States Patent
Rotter

(10) Patent No.: US 10,196,823 B2
(45) Date of Patent: Feb. 5, 2019

(54) ROOF RIDGE VENT

(71) Applicant: Martin J. Rotter, Glenside, PA (US)

(72) Inventor: Martin J. Rotter, Glenside, PA (US)

( * ) Notice: Subject to any disclaimer, the term of this patent is extended or adjusted under 35 U.S.C. 154(b) by 439 days.

(21) Appl. No.: 13/905,777

(22) Filed: May 30, 2013

(65) Prior Publication Data

US 2013/0324030 A1 Dec. 5, 2013

Related U.S. Application Data

(60) Provisional application No. 61/653,040, filed on May 30, 2012.

(51) Int. Cl.
*F24F 7/02* (2006.01)
*E04D 13/17* (2006.01)

(52) U.S. Cl.
CPC ..... *E04D 13/176* (2013.01); *F24F 7/02* (2013.01)

(58) Field of Classification Search
CPC ..... F24F 7/02; E04D 13/174; E04D 13/176; E04D 1/36; E04D 3/40; E04D 11/02; E04D 13/143; E04D 13/1606; E04D 13/178; E04D 2001/309; Y10T 428/17; Y10T 428/19; Y10T 428/24331; Y10T 428/24355; Y10T 428/24777
USPC ..... 454/365, 366; 52/199, 57, 198, 105, 52/302.3, 302.6, 309.4, 309.8, 518, 58, 52/60, 631, 748.7, 83, 94, 95, 96; 277/590; 428/138, 141, 192, 209, 219, 428/220, 33, 457, 461, 53, 57
See application file for complete search history.

(56) References Cited

U.S. PATENT DOCUMENTS 1,717,728 A 6/1929 Moore
4,138,935 A * 2/1979 Vallee ..... F24F 7/02 454/365
4,450,663 A 5/1984 Watkins
4,672,790 A * 6/1987 Freiborg ..... E04D 1/26 52/521
4,876,950 A 10/1989 Rudeen
4,924,761 A 5/1990 MacLeod
4,942,699 A * 7/1990 Spinelli ..... E04D 13/176 454/366
5,002,816 A 3/1991 Hofmann
5,149,301 A * 9/1992 Gates ..... E04D 13/174 454/365
5,167,579 A * 12/1992 Rotter ..... 454/365
5,427,571 A 6/1995 Sells
5,826,383 A 10/1998 Garrison
5,830,059 A 11/1998 Sells
5,947,817 A * 9/1999 Morris et al. ..... 454/365
6,015,343 A 1/2000 Castillo
(Continued)

*Primary Examiner* — Gregory Huson
*Assistant Examiner* — Frances F Hamilton
(74) *Attorney, Agent, or Firm* — Volpe and Koenig, P.C.

(57) ABSTRACT

A roof ridge vent system for roofs which includes a vent slot located through the roof structure along the roof ridge. A vent strip is provided that has a sufficient width to extend over the vent slot and partially over the shingles on each side of the vent slot. The vent strip has a longitudinal groove on an upper side located in a medial position that extends the length of the vent strip. The longitudinal groove forms a fold line to define a ridge line of the roof. Longitudinally extending glue strips are provided on a lower side of the vent strip adjacent to each of the longitudinal sides, which are adapted to contact the roofing on either side of the vent slot.

7 Claims, 2 Drawing Sheets

(56) References Cited

U.S. PATENT DOCUMENTS

| | | | | |
|---|---|---|---|---|
| 6,203,424 | B1 * | 3/2001 | Gallant | E04D 13/174 454/365 |
| 6,267,668 | B1 | 7/2001 | Morris | |
| 6,286,273 | B1 | 9/2001 | Villela | |
| 6,298,613 | B1 * | 10/2001 | Coulton et al. | 52/199 |
| 6,343,985 | B1 | 2/2002 | Smith | |
| 6,595,849 | B2 | 7/2003 | Miller | |
| 6,598,353 | B1 | 7/2003 | Reeves | |
| 7,182,688 | B2 * | 2/2007 | Coulton | 454/365 |
| 7,393,273 | B2 * | 7/2008 | Ehrman | F24F 7/02 454/365 |
| 7,694,479 | B2 * | 4/2010 | Killen | A47B 96/202 52/309.5 |
| 2003/0124300 | A1 * | 7/2003 | Gregorio | B29C 44/5627 428/69 |
| 2005/0126088 | A1 * | 6/2005 | Rotter | 52/198 |
| 2008/0229695 | A1 * | 9/2008 | Kalkanoglu et al. | 52/520 |
| 2009/0235598 | A1 * | 9/2009 | Miller | E04B 7/22 52/309.8 |
| 2011/0189940 | A1 * | 8/2011 | Kerwood-Winslow | E04D 13/17 454/365 |

* cited by examiner

ROOF RIDGE VENT

CROSS-REFERENCE TO RELATED APPLICATION

This application claims the benefit of U.S. Provisional Application No. 61/653,040, which was filed May 30, 2012, the entire contents of which are incorporated herein by reference as if fully set forth herein.

BACKGROUND

The present invention relates to a ridge vent for roofs, and in particular, to a ridge vent for use on asphalt shingle or other composition roofs, preferably having a pitch of at least 2/12.

It has been known to ventilate attics under gable roofs by running a vent along the roof ridge. Such vents are created during construction by sizing the uppermost row of sheathing panels to leave an open slot running along the ridge essentially the length of the roof. The slot creates effective heat ventilation by convection flow and suction caused by wind across the roof ridge. For retrofitting existing roofs, the slot can be cut along the roof ridge.

Soffit ventilators are perforated or louvered openings located along the eaves of an overhanging roof. The vents allow fresh ambient air to flow into the attic to equalize attic temperature and pressure with the outside. This equalization inhibits moisture from condensing on insulation and wood roofing materials which causes mildew and rot, prevents build-up of ice dams which could buckle shingles and gutters, and reduces air-conditioning costs when hot attic air is replaced by cooler ambient air.

A soffit ventilation system works in conjunction with a ridge vent to provide passive ventilation. As hot stale air is withdrawn from the ridge slot vent by convection and/or wind suction, it is replaced by fresh ambient air through the soffit vents.

One known ridge vent that has proven to be very successful is described in the inventor's prior U.S. Pat. No. 5,167,579. This roof vent is formed using a non-woven synthetic fiber mat having randomly aligned fibers located over a vent slot at the roof ridge. Cap shingles are then installed over the non-woven synthetic fiber mat. The synthetic fiber mat allows for air flow through the slot at the roof ridge, while preventing the ingress of moisture and debris. However, this type of ridge vent does not always form a clean ridge line due to the material becoming rounded as it extends over the slot and partially down on each side of the roof.

SUMMARY

Briefly stated, the present invention provides a roof ridge vent system for asphalt shingle or composition roofs which include a vent slot located through the roof structure along the roof ridge. A vent strip is provided that has a sufficient width to extend over the vent slot and partially over the shingles on each side of the vent slot. The vent strip has a longitudinal groove on an upper side located in a medial position that extends the length of the vent strip. The longitudinal groove forms a fold line to define a ridge line of the roof. Longitudinally extending glue strips are provided on a lower side of the vent strip adjacent to each of the longitudinal sides, which contact the asphalt shingles or composition roofing on either side of the vent slot. Peel strips can be provided on the glue strips that are removed prior to installation.

The vent strip can be provided either in stick or roll form.

BRIEF DESCRIPTION OF THE DRAWINGS

The present invention will be explained in more detail in connection with the drawings in which presently preferred embodiments are shown.

In the drawings.

DETAILED DESCRIPTION OF THE PREFERRED EMBODIMENTS

Figure 1:
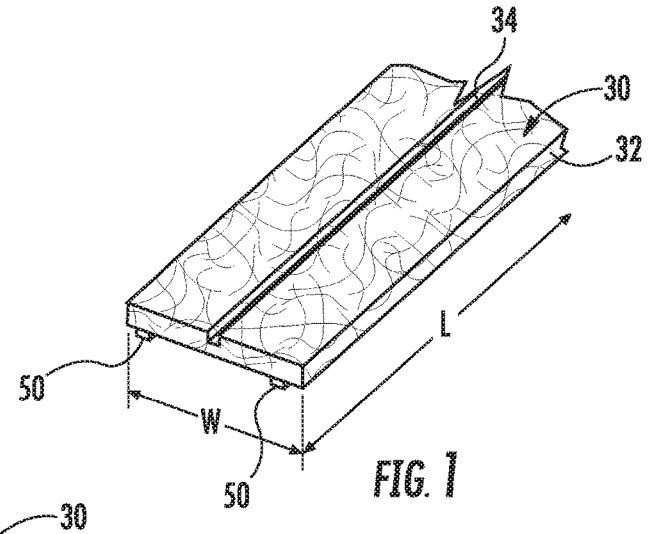
FIG. 1 is a perspective view of a vent strip according to the invention.

Certain terminology is used in the following description for convenience only and is not considered limiting. Words such as "front", "back", "top" and "bottom" designate directions in the drawings to which reference is made. This terminology includes the words specifically noted above, derivatives thereof and words of similar import. Additionally, the terms "a" and "one" are defined as including one or more of the referenced item unless specifically noted.

The preferred embodiments of the present invention will be described with reference to the drawing figures where like numerals represent like elements throughout.

Figure 2:
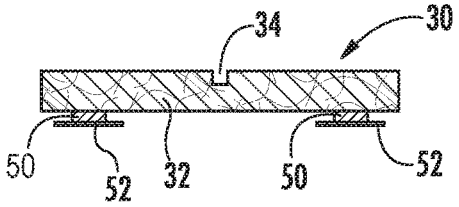
FIG. 2 is a cross-sectional view of the roof ridge vent shown in FIG. 1.

Referring to FIGS. 1 and 2, a vent strip 30 for use in a roof ridge vent system is shown. The vent strip 30 is comprised of a strip of vent material 32, which is preferably a non-woven matting as described in U.S. Pat. No. 5,167,579, which is incorporated herein by reference as if fully set forth. However, other vent materials could be used. The vent material 32 may be heat treated so that it "lofts" or expands, and then calendared down to a specific thickness to allow the completed vent strips to expand and conform to uneven surfaces when solar energy raises the roof temperature.

The vent strip 30 preferably includes a groove 34 that extends in a longitudinal direction in a medial location along the upper surface of the vent strip 30. A preferred vent strip 30 has a dimension width W of about 10.5 inches, and a thickness of about ¾ inches. The length L can vary. The vent strip 30 can be supplied in rolls of 10 feet or 20 feet, or other lengths. It can also be supplied in stick form, for example in 4 foot lengths. The groove 34 preferably has a depth that is at least about 25% of a thickness of the vent strip 30. For the exemplary dimensions given, the groove 34 is preferably at least ⅛ inch wide and approximately 3/16 inches deep. The groove 34 is preferably cut into the vent strip 30 and cuts or disrupts the fibers in the non-woven matting that forms the vent strip 30 to allow the vent strip 30 to fold at a sharp angle as compared to a non-grooved mat of the same material due to the cut fibers not acting in tension to try to spring back to their original position. Those skilled in the art will recognize that the dimensions can be varied depending on the particular roofing material and other factors. The depth of the groove 34 being at least about 25% of the thickness of the ridge vent 30 formed from the non-woven matting ensures a distinct fold line at installation in order to allow a clear ridge line to be formed, instead of the rounded profile of the prior art.

The vent strip 30 is adapted to be adhered to the shingles or roofing material by an adhesive 50 applied in longitudinal strips along the longitudinal edges on the lower surface of the vent strip 30. The adhesive 50 is preferably in the form of adhesive strips, of the type known in the art. These adhesive strips preferably include a release strip 52 which, when removed, reveals an adhesive such as acrylic or silicone.

Figure 3:
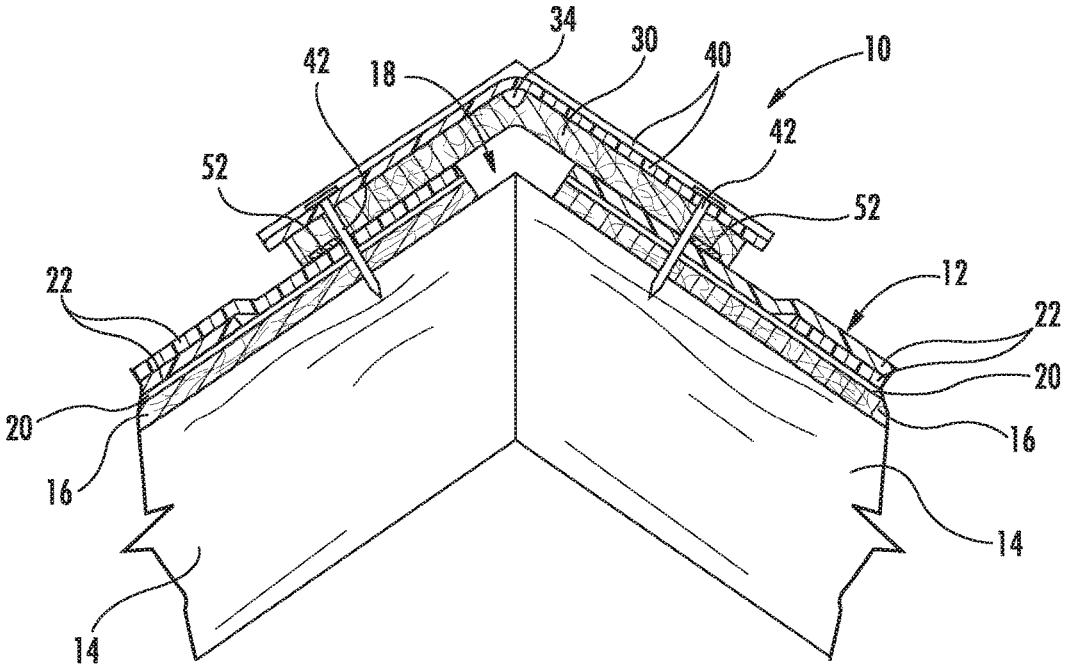
FIG. 3 is a cross-sectional view of the roof ridge vent system using the roof ridge vent of FIGS. 1 and 2

Referring now to FIG. 3, a roof ridge ventilation system 10 using the vent strip 30 is shown. The ventilation system 10 is installed on a roof 12, preferably having a 2/12 pitch or greater. The roof 12 is formed from rafters 14 having a sheathing 16, as shown, installed thereon. Alternatively, purlins or other support structures can be utilized. The sheathing 16 may end below the ridge peak or may be cut back so that a vent slot 18 is formed at the peak. Preferably, tar paper, roofing felt, or another type of moisture impervious layer 20 is installed over the sheathing 16 prior to asphalt shingles 22, another type of composition roofing material, or any other generally flat roofing material being installed up to the vent slot 18.

The vent strip 30 according to the invention is then installed over the vent slot 18 so that the longitudinal sides extend over and contact the shingles 22 along the vent slot 18. Here, the release strips 52 for the glue strips 50 have been removed, and the glue strips 50 aid in positioning and holding the vent strip 30 in position as the ridge cap shingles 40 are installed using nails 42. The glue strips 50 also help to prevent lifting of the vent strip 30 that could allow wind driven rain to enter between the lower side of the vent strip 30 and the upper surface of the shingles 22.

Figure 4:
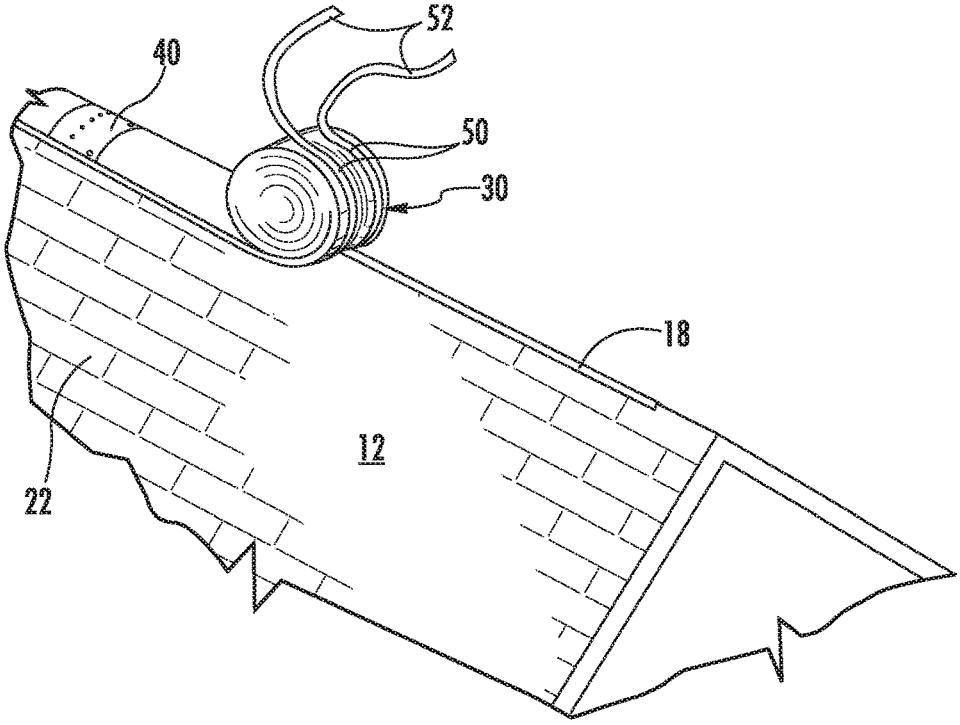
FIG. 4 is a perspective view showing the continuous process used to install the vent strip of FIG. 1 in roll form.

Referring to FIG. 4, a roll 34 of the vent strip material 30 allows the vent strip 30 to be installed as a generally continuous strip by peeling off the release strips 52 to expose the glue strips 50 and folding the vent strip 30 about the groove 34 in order to form the ridge line, and then positioning ridge cap shingles 40 over the vent strip 30 and nailing them in place. The roll of material can be cut to the desired length, or if additional length is needed, an additional roll of the vent strip can be joined to the prior roll with a butt joint that is joined together with silicone sealant.

Figure 5:
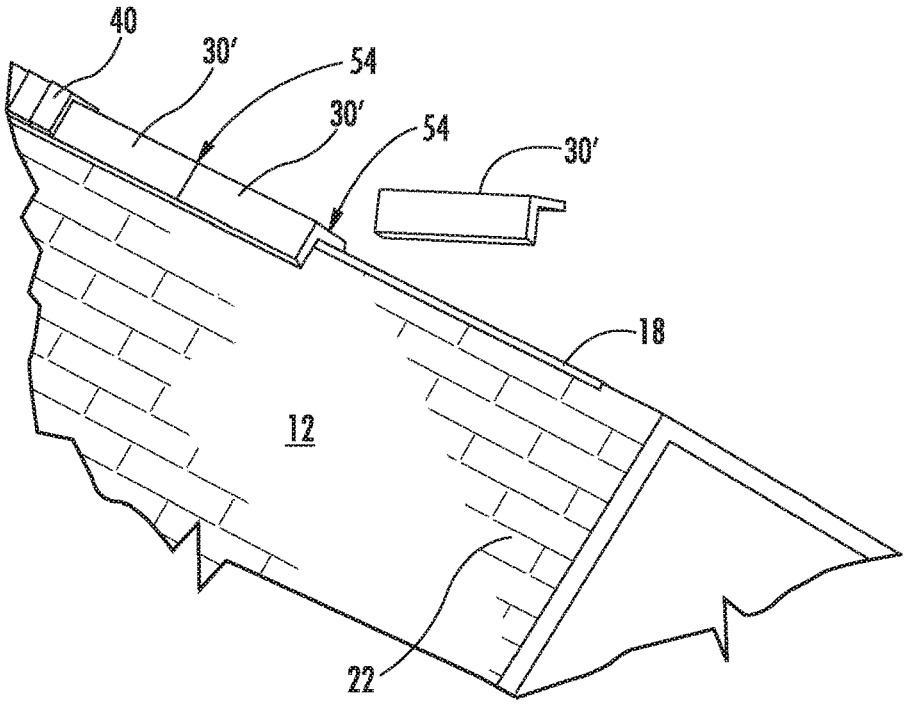
FIG. 5 is a perspective view showing the process used to install the vent strip of FIG. 1 in stick form.

Referring to FIG. 5, the vent strip 30 can also be provided in stick form, designated 30', for easier handling on small jobs, and any seams also formed by butt joints 54 that are connected together by silicone sealant.

In use, vent strip 30 prevents moisture, for example wind driven rain that travels parallel to the roof ridge from reaching the vent slot 18 by acting as an air permeable baffle, that reduces the velocity of the incoming wind driven rain so that it drops to the surface of the shingle 22 and is allowed to run back down the roof. The vent material 32 also generally prevents the ingress of insects and debris in the up-slope direction of the roof.

While the preferred embodiments of the invention have been described in detail, the invention is not limited to these specific embodiments described above which should be considered as merely exemplary. Further modifications and extensions of the present invention may be developed and all such modifications are deemed to be within the scope of the present invention as defined by the appended claims.

What is claimed is:

1. A roof ventilation system for roofs which includes a vent slot located through the roof structure along a roof ridge, comprising:

a vent strip consisting of a non-woven matting, the vent strip having a generally constant material thickness that has a sufficient width to extend over the vent slot and partially over the roof on each side of the vent slot, the vent strip has a longitudinal groove on an upper side located in a medial position that extends a length of the vent strip, the longitudinal groove forms a fold line to define a ridge line of the roof, the vent strip including cut fibers at the longitudinal groove, and the vent strip is provided in roll form, wherein the vent strip contacts the roof on both sides of the vent slot; and longitudinally extending glue strips are located on a lower side of the vent strip adjacent to longitudinal edges of the vent strip, the glue strips contact the roof on both sides of the vent slot.

2. The roof ventilation system according to claim 1, wherein peel strips are removably located on the glue strips and are removed prior to installation.

3. The roof ventilation system according to claim 1, wherein the vent strip is provided in stick form, each of the sticks having a length of about 4 feet, and adjacent sticks are joined by a butt joint with a silicone sealant.

4. The roof ventilation system according to claim 1, wherein the longitudinal groove has a depth that is about 25% of a thickness of the vent strip.

5. The roof ventilation system according to claim 1, further comprising:

a first plurality of shingles arranged on each side of the vent slot, the vent strip engaging an upper surface of each one of the first plurality of shingles, and a ridge cap shingle that engages the upper side of the vent strip to hold the vent strip in place.

6. The roof ventilation system according to claim 5, further comprising nails that secure the ridge cap shingle and the vent strip to the roof.

7. The roof ventilation system according to claim 1, wherein the vent strip is 3/4 inches thick, and the groove is 1/8 inch wide and 3/16 inches deep.

* * * * *